US012121112B1

(12) United States Patent
Lawson et al.

(10) Patent No.: US 12,121,112 B1
(45) Date of Patent: Oct. 22, 2024

(54) QUICK-RELEASE CAM BUCKLE ASSEMBLY

(71) Applicant: Titan Straps LLC, Bozeman, MT (US)

(72) Inventors: Cameron Lawson, Bozeman, MT (US); Jeff Wyatt, Bozeman, MT (US); Stefan Benier, Bozeman, MT (US); Alan J Dayvie, Bozeman, MT (US)

( * ) Notice: Subject to any disclaimer, the term of this patent is extended or adjusted under 35 U.S.C. 154(b) by 0 days.

(21) Appl. No.: 18/227,953

(22) Filed: Jul. 30, 2023

(51) Int. Cl.
*A44B 11/12* (2006.01)
*A44B 11/06* (2006.01)
*A44B 11/16* (2006.01)

(52) U.S. Cl.
CPC ..... *A44B 11/06* (2013.01); *A44B 11/16* (2013.01); *Y10T 24/4016* (2015.01)

(58) Field of Classification Search
CPC ..... Y10T 24/4016; Y10T 24/3403; Y10T 24/4736; Y10T 24/4764; Y10T 24/4086; A44B 11/02; A44B 11/25; A44B 11/006; A44B 11/18; A44B 11/06; A44B 11/12; A44B 11/16
See application file for complete search history.

(56) References Cited

U.S. PATENT DOCUMENTS 2,563,809 A * 8/1951 Ash ..... A44B 11/06 24/197
2,807,852 A * 10/1957 Rave ..... A44B 11/2588 D11/218
3,253,309 A * 5/1966 Baresch ..... B65D 63/16 24/170
4,501,027 A * 2/1985 Olsson ..... A44B 11/28 2/920
5,205,021 A 4/1993 Durand
6,735,826 B2 5/2004 Uehara et al.
8,522,728 B2 * 9/2013 Davis, Jr. ..... A44B 11/12 119/863
8,898,870 B2 * 12/2014 Chan ..... A44B 11/25 24/589.1
11,129,448 B1 * 9/2021 Cretikos ..... A44B 11/12
2002/0090275 A1 7/2002 Zhan et al.
2010/0312271 A1 * 12/2010 Chao ..... A61B 17/1327 606/203
2012/0216757 A1 * 8/2012 Davis, Jr. ..... A01K 27/001 119/863
2014/0026373 A1 1/2014 Seader

FOREIGN PATENT DOCUMENTS

EP 0513485 A1 11/1992
EP 2978635 B1 5/2020

* cited by examiner

*Primary Examiner* — Robert Sandy
*Assistant Examiner* — Michael S Lee
(74) *Attorney, Agent, or Firm* — Antoinette M. Tease

(57) ABSTRACT

A quick-release buckle with a main body, a plate, and a strap. The main body has a frame and a release lever that rotates about a shaft. The plate has two parallel and longitudinal slots, and the strap passes through the slots in the plate. The frame has two parts that are separated by an angled wall that extends laterally across the frame width. The shaft is secured to the first part of the frame. The second part of the frame is configured to form a seat for receiving the plate. The second part of the frame has two side walls and a channel on an inside surface of each side wall adjacent to the angled wall. Each channel is parallel to the angled wall and at least as wide as the thickness of the plate. The two channels together are configured to receive the width of the plate.

7 Claims, 10 Drawing Sheets

QUICK-RELEASE CAM BUCKLE ASSEMBLY

BACKGROUND OF THE INVENTION

1. Field of the Invention

The present invention relates generally to the field of buckles, and more particularly, to a two-part quick-release cam buckle that can be coupled and de-coupled without engagement of the release lever.

2. Description of the Related Art

Typical "cam strap" buckles require the user to thread one end of the webbing (or strap) through the buckle and then pull the excess webbing through the release lever until the strap is secure. Over time, the tip of the webbing may get frayed or worn, or it may attract ice in cold weather, all of which occurrences make it difficult to thread the tip of the webbing through the narrow slot of the buckle. Furthermore, to remove the strap from the object around which it extends, the user must pull the entire length of webbing through the release lever (while the release lever is maintained in an open position by exerting force against the release lever spring), which can take some time if the strap is several feet long.

The present invention solves these problems by providing a plate that is separate from but proximate to the release lever. The strap is "pre-threaded" through and secured to the plate, which snaps into place onto the buckle when the user is ready to secure the strap around an object. The length of the strap is then adjusted by pulling it through the release lever; in contrast to conventional cam buckles, the strap does not need to be completely removed from the release lever in order for the buckle to function. To unfasten the buckle, the user simply exerts sufficient pressure on the release lever to create a bit of slack in the strap and then directs the plate through a slot in the buckle, thereby de-coupling the plate from the rest of the buckle assembly. Because the strap is pre-threaded and secured to the plate, the user never has to thread a frayed end of the strap through the buckle. In this manner, the process of unsecuring the strap from around an object is much faster than it is using a conventional cam buckle. Furthermore, the present invention is designed so that the plate will never disengage from the buckle when there is any tension at all on the strap.

U.S. Pat. No. 8,898,870 (Chan. 2014) discloses a buckle assembly having a base portion with a strap retaining bar and an inner opening disposed between the side walls of the base portion. The buckle assembly also includes a locking portion with a strap retaining bar and a protrusion that extends outwardly from each of the side walls of the locking portion. The length of the locking portion is greater than the length of the opening, and the width of the opening is wider than the width of the locking portion. The side walls of the base portion each has a slot that is configured to accommodate the protrusions on the locking portion when it is placed onto the base portion. The locking portion is couple to the base portion by sliding the locking portion through the opening from the bottom side to the top side of the base portion, aligning the locking portion so that it extends parallel to the base portion, and then snapping the protrusions into the slots.

U.S. Pat. No. 6,735,826 (Uehara et al., 2004) describes a buckle that is comprised of a main body and an engagement member. The main body has a base part, at least two insertion holes, and an upstanding piece provided in between the insertion holes for bending the belt in a direction away from the base part. When the engagement member is in a first position, the buckle can be moved relative to the belt, and when the engagement member is in a second position, the buckle is fixed relative to the belt. The engagement member has a pressurizing part, which pressurizes the belt in the second position so as to obtain a further bent state of the belt. The engagement member also has an adjustor that is capable of adjusting the length of the other end of the belt.

U.S. Pat. No. 5,205,021 (Durand, 1993) provides a quick-release buckle assembly with an engaging member that is adapted to receive a strap and a receiving member that defines a recess for removably receiving the engaging member. The engaging member, when in a buckle-engaged position, is substantially completely within the peripheral bounds of the recess to prevent inadvertent disengagement of the engaging member from the receiving member. The buckle assembly also includes a flexible tongue that protrudes from the engaging member and allows the engaging member to be pulled out of the recess, thereby disengaging the buckle.

U.S. Patent Application Pub. No. 2014/0026373 (Seader) describes a flat strap holding apparatus comprised of a body and a rotating hub, which rotates in an interior of the body. The rotating hub has a gripping surface that is proximate to a gripping area in the interior of the body, and the rotating hub is configured to rotate toward and away from the gripping area. The body also has an attachment area, which has a plurality of apertures and a plurality of bars, the bars being oriented parallel to each other. The attachment area is located on one side of the body, and the interior is located on another side of the body. The "interior" is also referred to as the "cam area." In a preferred embodiment, the gripping surface of the hub extends radially away from a rotation point of the hub, and the gripping surface is positioned so that it opposes the gripping area of the body such that the hub rotates around the rotation point and moves closer and farther away from the gripping area depending on the direction of rotation.

U.S. Patent Application Pub. No. 2002/0090275 (Zhan et al.) involves a cargo snugger strap and hook mechanism in which an anchor with an L-shaped aperture is configured to receive an end of a strap pin and to lock the pin in place. The pin is held in place when not under load by a clip member on the back of the anchor. An anchor fitting is configured to attach the mechanism to the wall or floor of a transport vehicle.

BRIEF SUMMARY OF THE INVENTION

The present invention is a quick-release buckle comprising: a main body comprising a frame and a release lever that rotates about a shaft; a plate having two parallel and longitudinal slots, wherein the plate has a thickness and a width; and a strap that passes through the slots in the plate; wherein the frame comprises a first part and a second part; wherein the first part of the frame and the second part of the frame are separated by an angled wall that extends laterally across a width of the frame; wherein the shaft is secured to the first part of the frame; wherein the second part of the frame is configured to form a seat for receiving the plate; and wherein the second part of the frame comprises two side walls and a channel on an inside surface of each side wall adjacent to the angled wall, each channel being parallel to the angled wall and at least as wide as the thickness of the plate, and wherein the two channels together are configured to receive the width of the plate.

In one embodiment, the strap is secured to itself with stitching after passing through the two slots in the plate. In another embodiment, the strap is secured to itself with adhesive after passing through the two slots in the plate.

In a preferred embodiment, the release lever comprises a spring that is situated around a center part of the shaft and configured to maintain the release lever in a closed position unless a user exerts manual force against the spring. Preferably, the invention further comprises a plurality of teeth on the front of the release lever.

In a preferred embodiment, the release lever comprises a thumb pad, and the thumb pad comprises a plurality of rows of protrusions that increase in height from a front of the thumb pad to a back of the thumb pad. The frame comprises a top edge, and the angle of the angled wall relative to the top edge of the frame is preferably in the range of fifteen to forty-five degrees.

REFERENCE NUMBERS

1 Main body (of buckle assembly)
2 Plate (of buckle assembly)
3 Strap
4 Frame (of main body)
5 Release lever (of main body)
6 Spring
7 Shaft
8 First part (of frame)
9 Second part (of frame)
10 Thumb pad (on release lever)
11 Protrusions (on thumb pad)
12 Teeth (on release lever)
13 Side wall (of second part of frame)
13*a* Inner wall (on second part of frame)
14 Rear stop (of frame)
15 Angled wall (between first and second parts of frame)
15*a* Top surface (of angled wall)
16 Recess (on side wall of second part of frame)
17 Side wall (of first part of frame)
18 Front part (of frame)
19 Ledge (in main body)
20 Slot (in plate)

DETAILED DESCRIPTION OF INVENTION

Figures 1A, 1B:
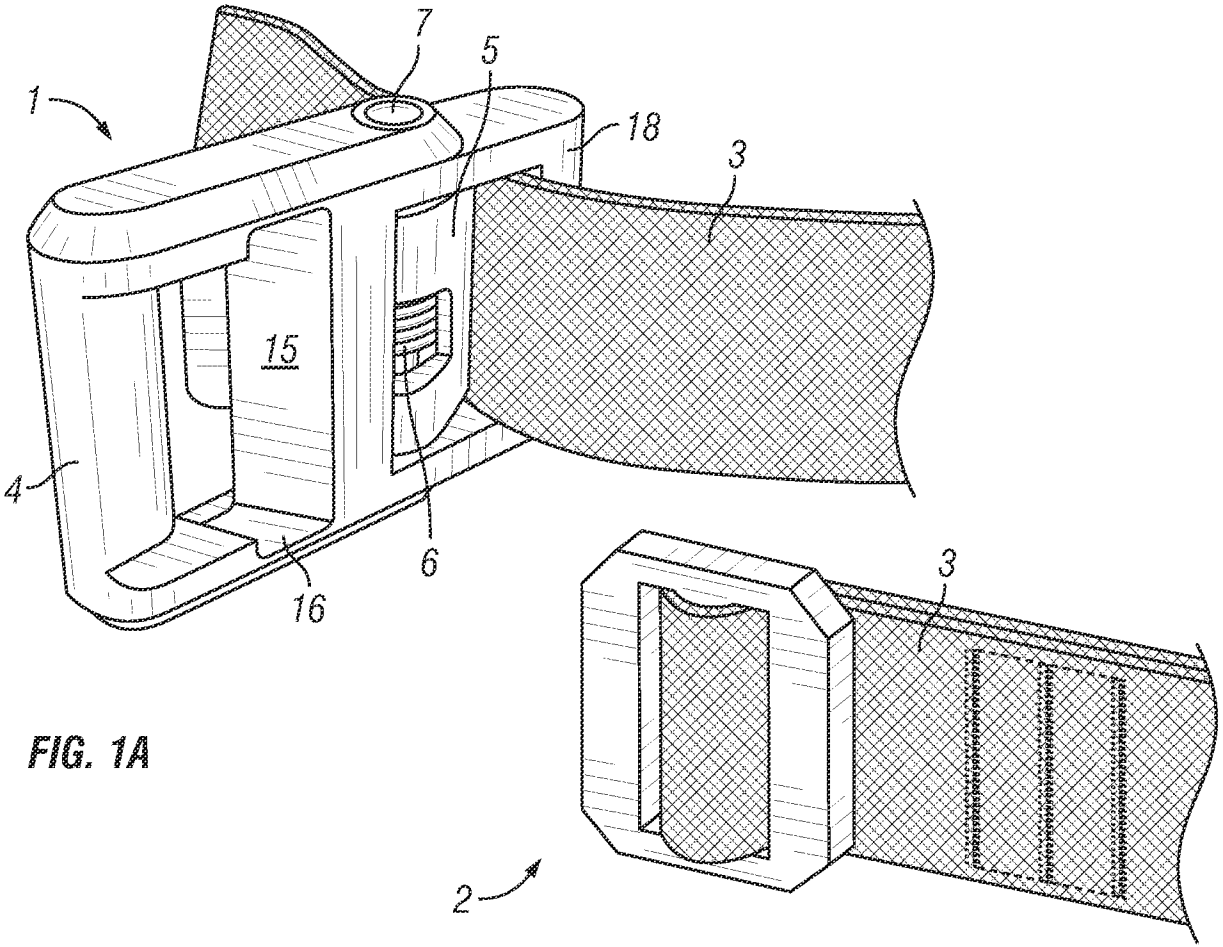
FIG. 1A is a bottom perspective view of the main body of the buckle assembly of the present invention shown with the strap inserted through the frame of the main body.
FIG. 1B is a perspective view of the plate of the buckle assembly of the present invention shown with the strap attached to it.

FIG. 1A is a bottom perspective view of the main body of the buckle assembly of the present invention shown with the strap inserted through the frame of the main body, and FIG. 1B is a perspective view of the plate of the buckle assembly of the present invention shown with the strap attached to it. As shown in these two figures, the present invention is comprised of a main body 1 and a plate 2. The strap 3 is preferably secured to itself after passing through the plate 2 with stitching, as shown. In an alternate embodiment, an adhesive may be used in lieu of stitching.

Figure 11:
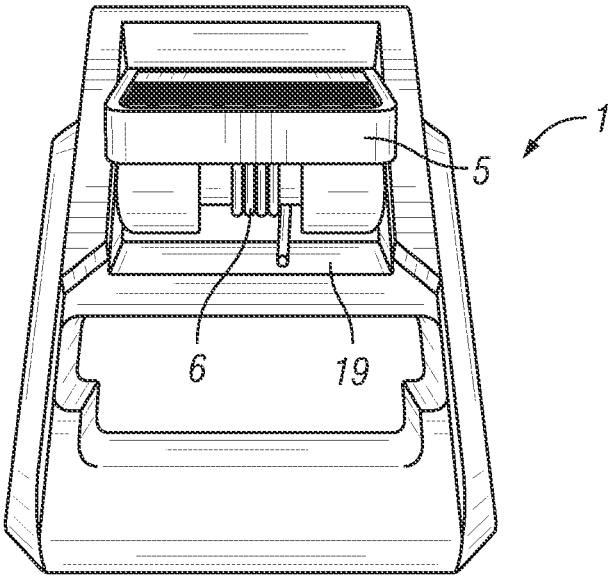
FIG. 11 is a perspective view of the main body of the present invention showing a first spring connection point.
Figure 12:
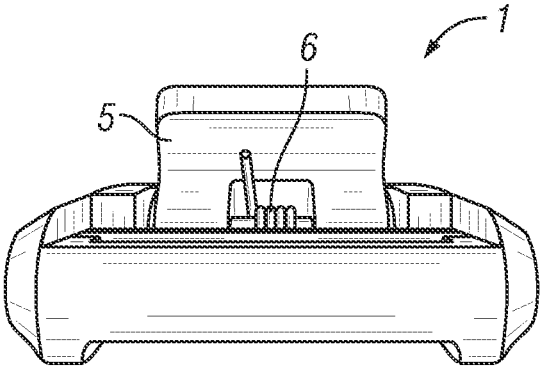
FIG. 12 is a second perspective view of the main body of the present invention showing a second spring connection point.
Figure 13:
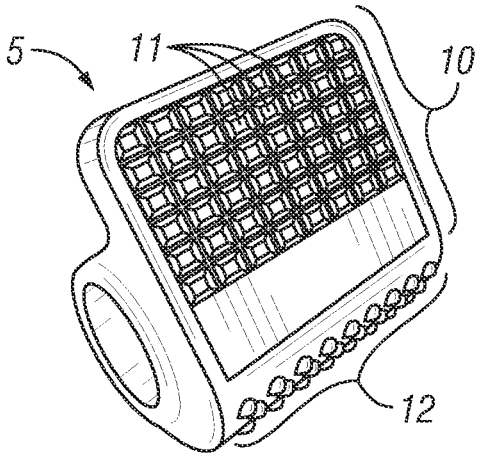
FIG. 13 is a perspective view of the thumb pad of the present invention.

The main body is comprised of a frame 4 that is generally rectangular in shape and a release lever 5. The release lever 5 comprises a spring 6 that is configured to maintain the release lever in a closed position unless the user exerts manual force against the spring to open the release lever. The release lever 5 rotates about a shaft 7, and the spring 6 is situated around the center of the shaft. One end of the spring 6 is anchored by a ledge 19 in the center and at the bottom of the frame 4 (see FIGS. 10 and 11), and the other end of the spring 6 abuts up against the top of an opening in the rear of the release lever itself (see FIG. 12). The ledge 19 extends laterally across the width of the main body 1. In this manner, the spring 6 is configured so that when the user presses down on the thumb pad 10 (see FIG. 4), the spring is compressed, the release lever 5 rotates about the shaft 7, and the teeth 12 on the front of the release lever (see FIG. 13) move away from and are no longer in contact with the strap 3, thereby allowing the user to pull the strap through the first part 8 of the frame between the front of the release lever 5 and the front part 18 of the frame (see also FIG. 4).

Figure 8:
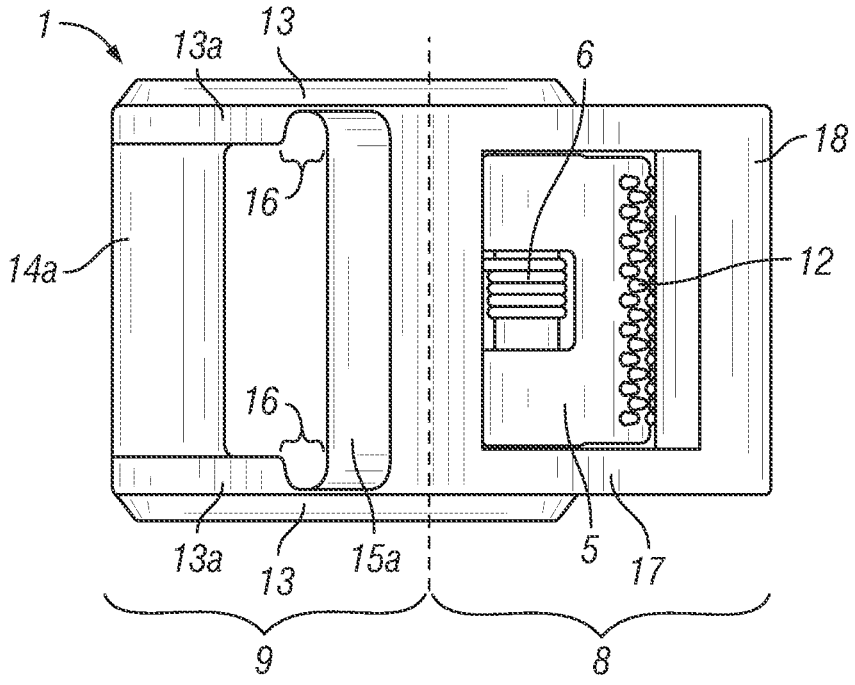
FIG. 8 is a bottom view of the main body of the present invention shown without the strap and plate.
Figure 9:
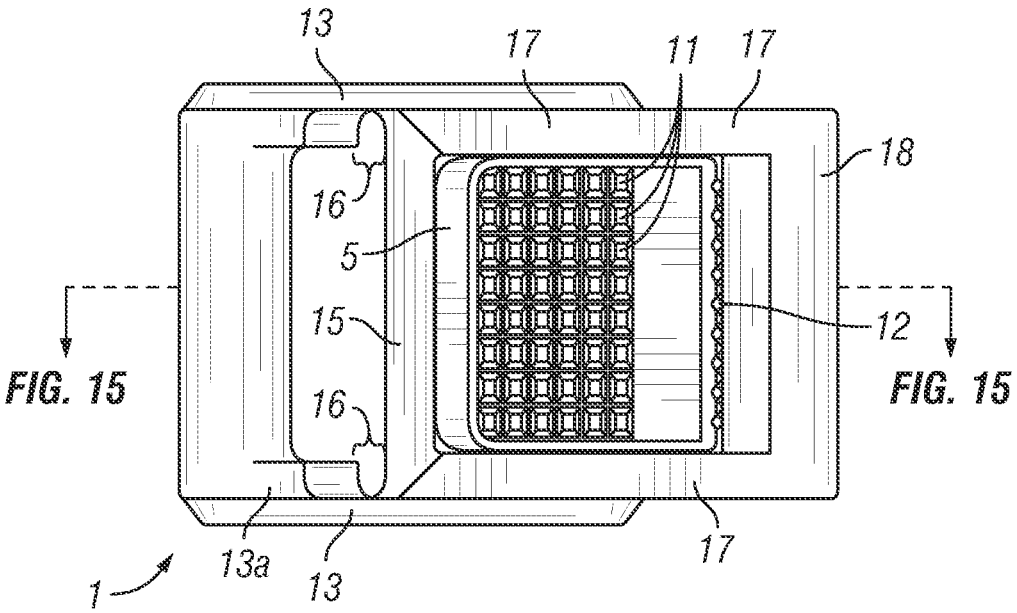
FIG. 9 is a top view of the main body of the present invention shown without the strap and plate.
Figure 14:
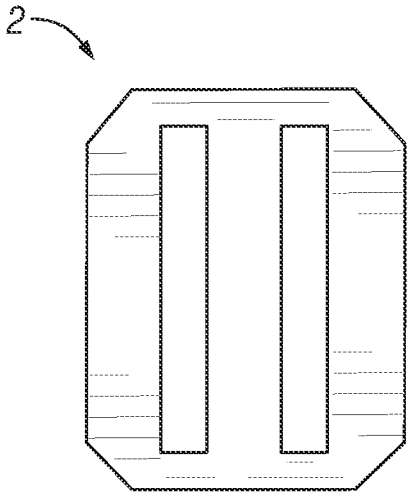
FIG. 14 is a top view of the plate shown without the strap.
Figure 15:
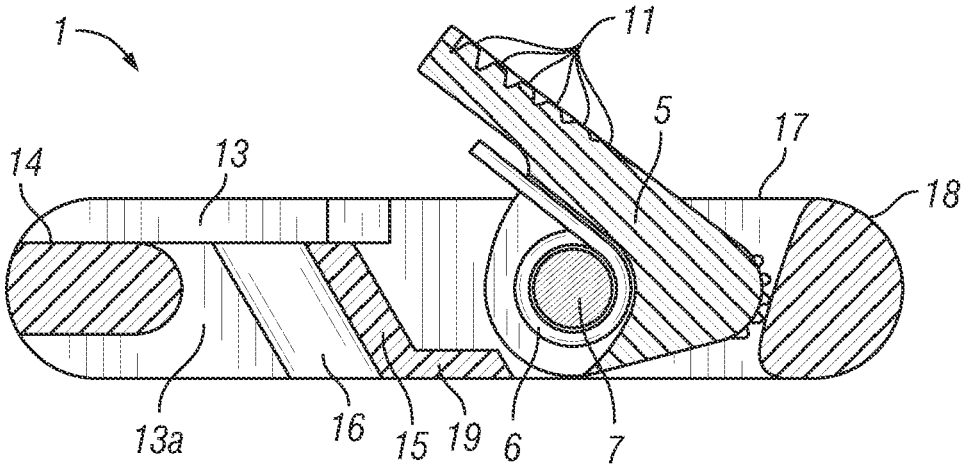
FIG. 15 is a section view of the main body.

As shown in FIG. 14, the plate 2 is a flat plate with two parallel slots 20 that are configured to receive the width of the strap 3. As shown in FIG. 8, the main body 1 is comprised of a first part 8 and a second part 9. The first part 8 is configured to hold the shaft 7 and spring 6 and the bottom part of the release lever 5. The top part of the release lever 5 is a thumb pad 10 that preferably comprises a plurality of protrusions 11. In a preferred embodiment, the protrusions 11 increase in height from the front of the thumb pad to the back of the thumb pad (the back of the thumb pad being that part of the thumb pad that is situated over the middle part of the frame 4), as shown in FIG. 15. The purpose of the protrusions 11 is to facilitate the gripping of the user's thumb on the thumb pad 10. The front of the release lever 5 comprises a plurality of teeth 12 (see FIG. 13) that are configured to grip the strap 3 when the release lever is in a closed position (with no force being exerted on the spring 6). The second part 9, which is discussed more fully below, is configured to receive the plate 2.

Figure 2A:
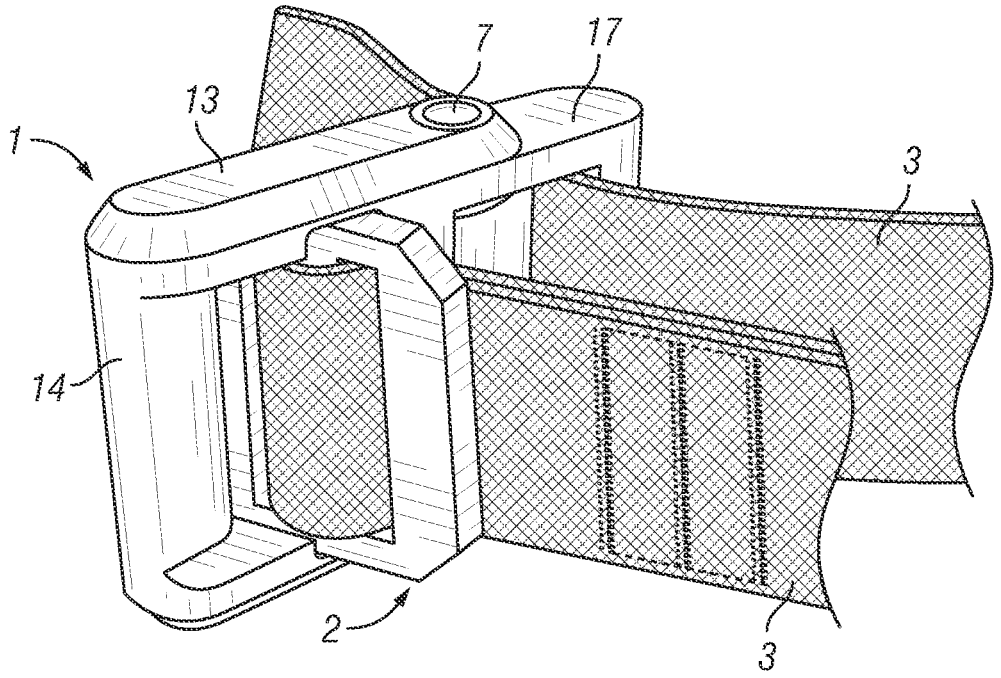
FIG. 2A is a perspective view of the present invention shown with the plate inserted into the underside of the second part of the frame.
Figure 7:
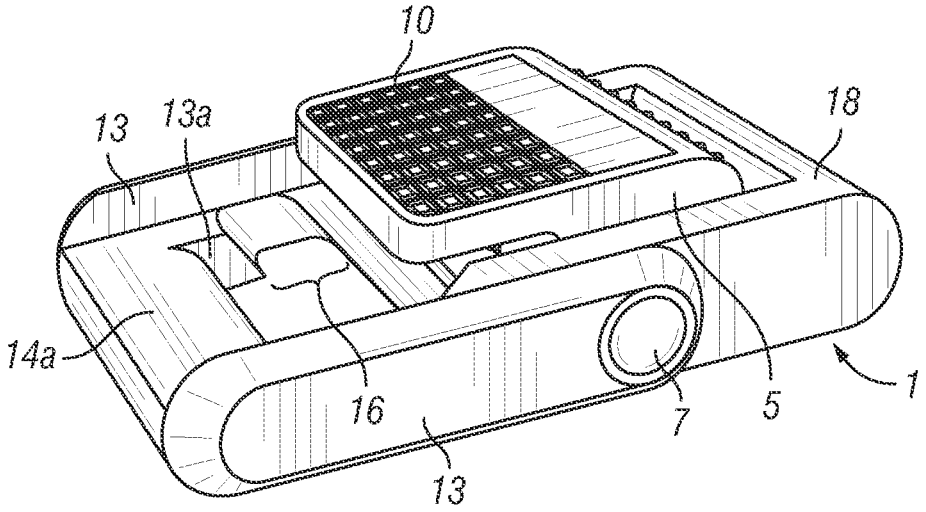
FIG. 7 is a perspective view of the main body of the present invention shown with the release lever in a fully open position and the strap and plate omitted for clarity.

FIG. 2A is a perspective view of the present invention shown with the plate inserted into the underside of the second part of the frame. The second part 9 of the frame 4 comprises two side walls 13, a rear stop 14 that extends between the two side walls 13 and forms the rear-most end of the buckle assembly, and an angled wall 15 situated in the center of the frame 4 between the first and second parts 8, 9. On either side of the angled wall are two recesses 16 on the interior of the side walls 13. These recesses 16 are also angled (see FIG. 1A), and they are configured to receive the plate 2 so that when the plate 2 is inserted into the second part 8 directly behind the angled wall 15, the plate is directed through the second part 8 at an angle (see FIGS. 2A and 15). Note that when the release lever 5 is pressed all the way down, the thumb pad 10 rests on top of the angled wall 15 but does not extend behind it (which would block passage of the plate 2 through the recesses 16) (see FIG. 7). Note also that the two side walls 13 overlap with the side walls 17 of the first part and that the shaft 7 extends through both sets of side walls 13, 17 (see also FIG. 10).

Figure 2B:
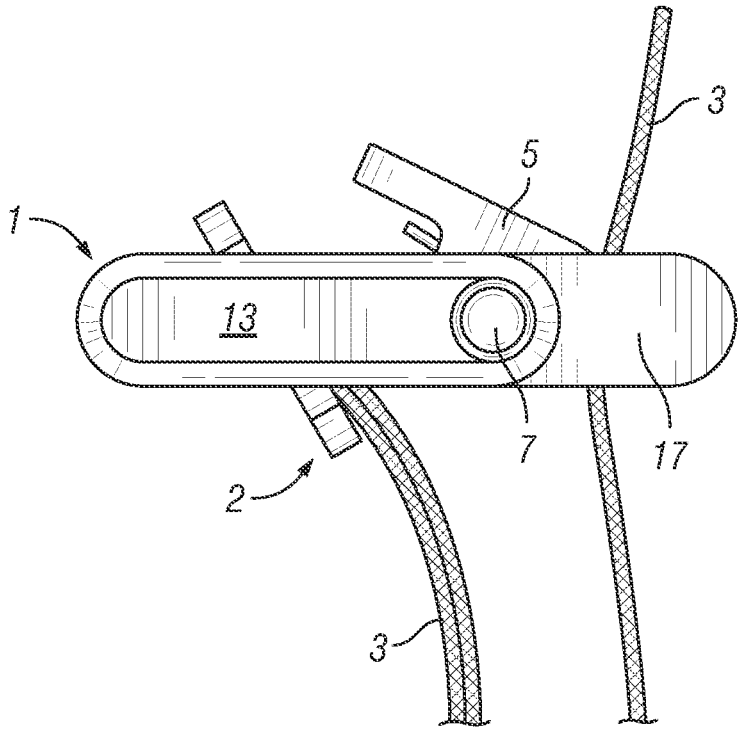
FIG. 2B is a side view of the present invention shown with the plate in the same position as in FIG. 2A.

FIG. 2B is a side view of the present invention shown with the plate in the same position as in FIG. 2A. Note the angle of the plate 2 as it extends through the channels 16 in the main body 1. This angle matches the angle of the channels 16 relative to the bottom and top edges of the main body frame. In a preferred embodiment, this angle is approximately thirty degrees (30°) from vertical (see FIG. 15). In a preferred embodiment, this angle is between fifteen (15) and forty-five (45) degrees.

Figure 3:
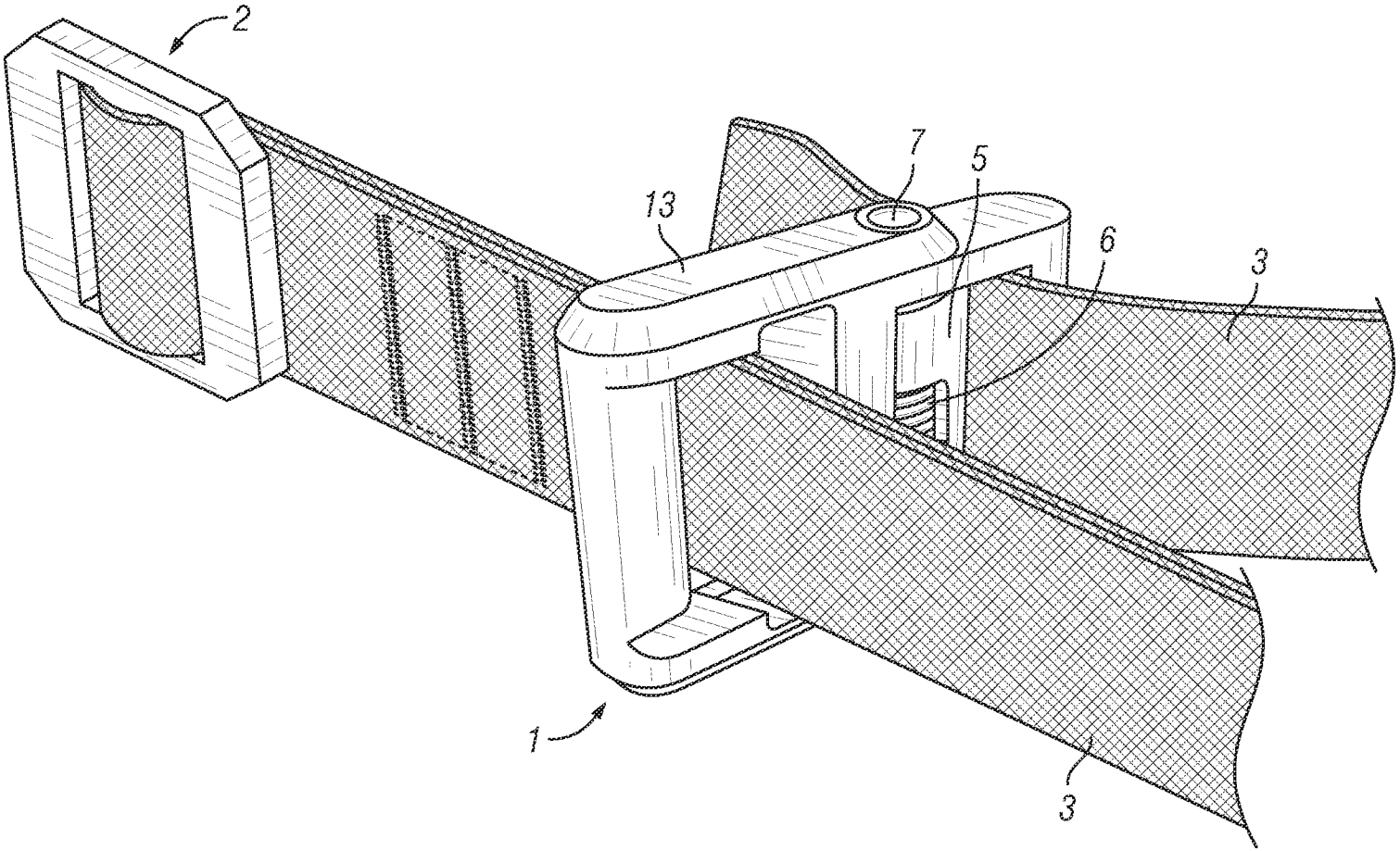
FIG. 3 is a perspective view of the present invention shown with the plate inserted through the underside of the second part of the frame.
Figure 4:
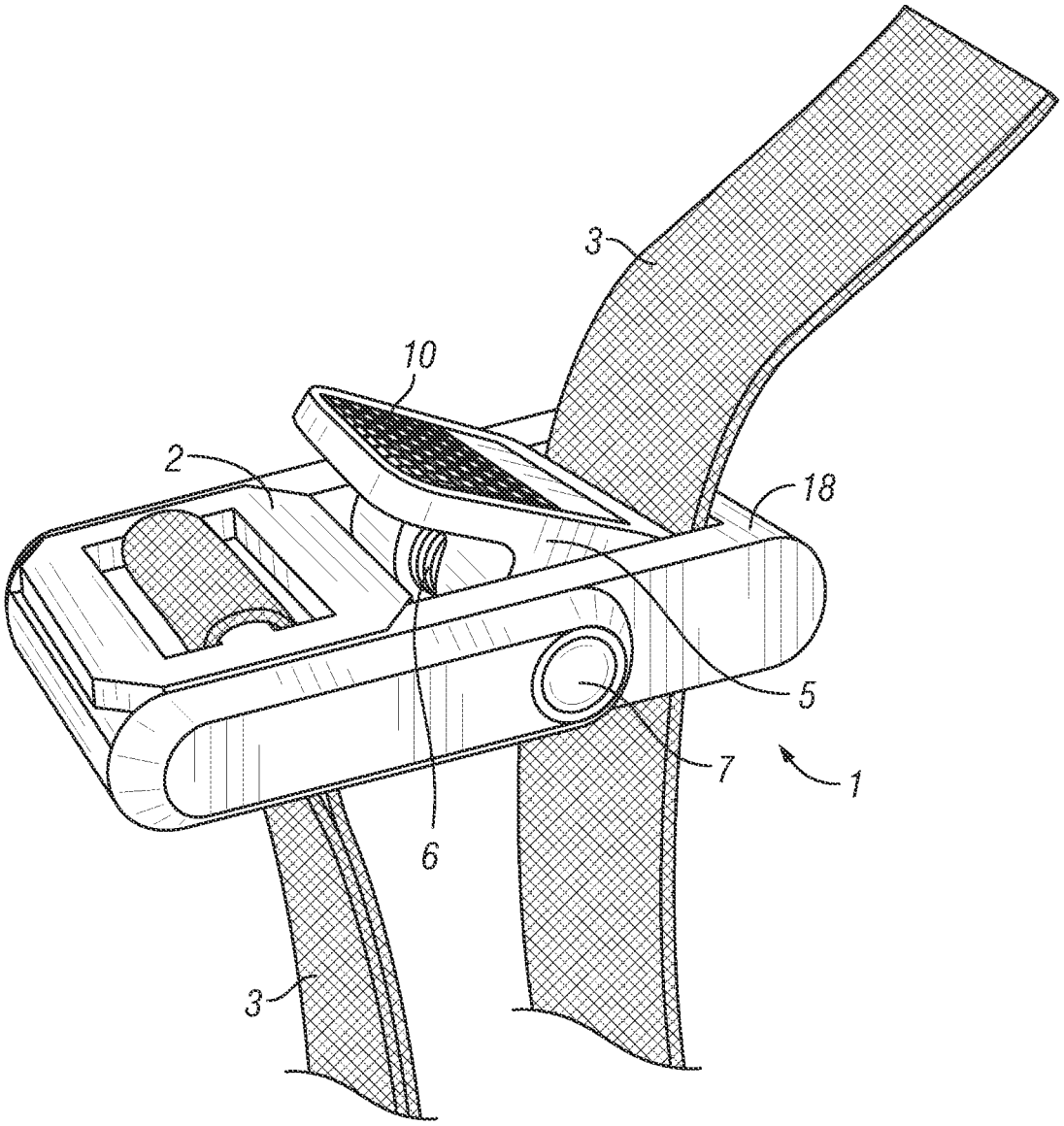
FIG. 4 is a top perspective view of the present invention shown with the plate seated on top of the first part of the frame.
Figure 10:
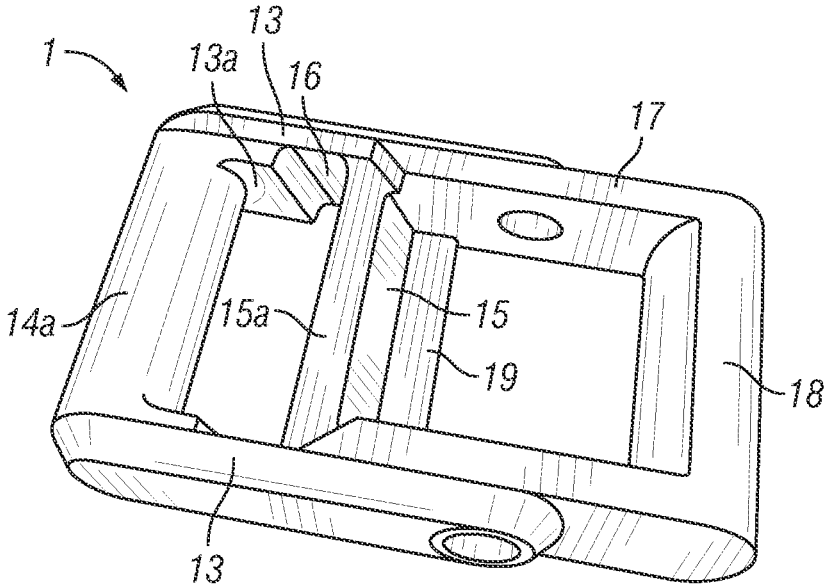
FIG. 10 is a top perspective view of the main body of the present invention shown without the strap and plate.

FIG. 3 is a perspective view of the present invention shown with the plate inserted through the underside of the second part of the frame. In this figure, the plate 2 has been pulled all the way through the second part 8. In the next step (FIG. 4), the plate 2 is rotated so that it is parallel to the main body 1, and the strap 3 is pulled back down through the second part 8 until the plate is seated on top of the second part 8 of the frame 4. As shown in FIG. 10, the angled wall 15 comprises a top surface 15*a* that forms part of the "seat" in the first part of the frame onto which the plate 2 is situated when the buckle assembly is fastened. Two inner walls 13*a* extend partway across each of the side walls 13 to form the recesses 16 discussed above. The inner walls 13*a* extend to the bottom edges of the side walls 13, but they stop short of the top edges of the side walls 13 (see FIG. 15), thereby forming two surfaces upon which the sides of the plate 2 can rest when the buckle assembly is fastened. Similarly, the rear stop 14 comprises a flat top surface 14*a* (see FIG. 7) that is lower than the top edge of the side walls 13 and contiguous with the top surface of each of the inner walls 13*a*. Thus, the plate 2 also rests upon the top surface 14*a* of the rear stop 14 when the buckle assembly is fastened. The top surface 15*a* of the angled wall 15, the top surfaces of the inner walls 13*a*, and the top surface 14*a* of the rear stop 14 are all at the same level and, collectively, form the "seat" onto which the plate rests when the buckle assembly is fastened, as shown in FIG. 4.

Figure 5:
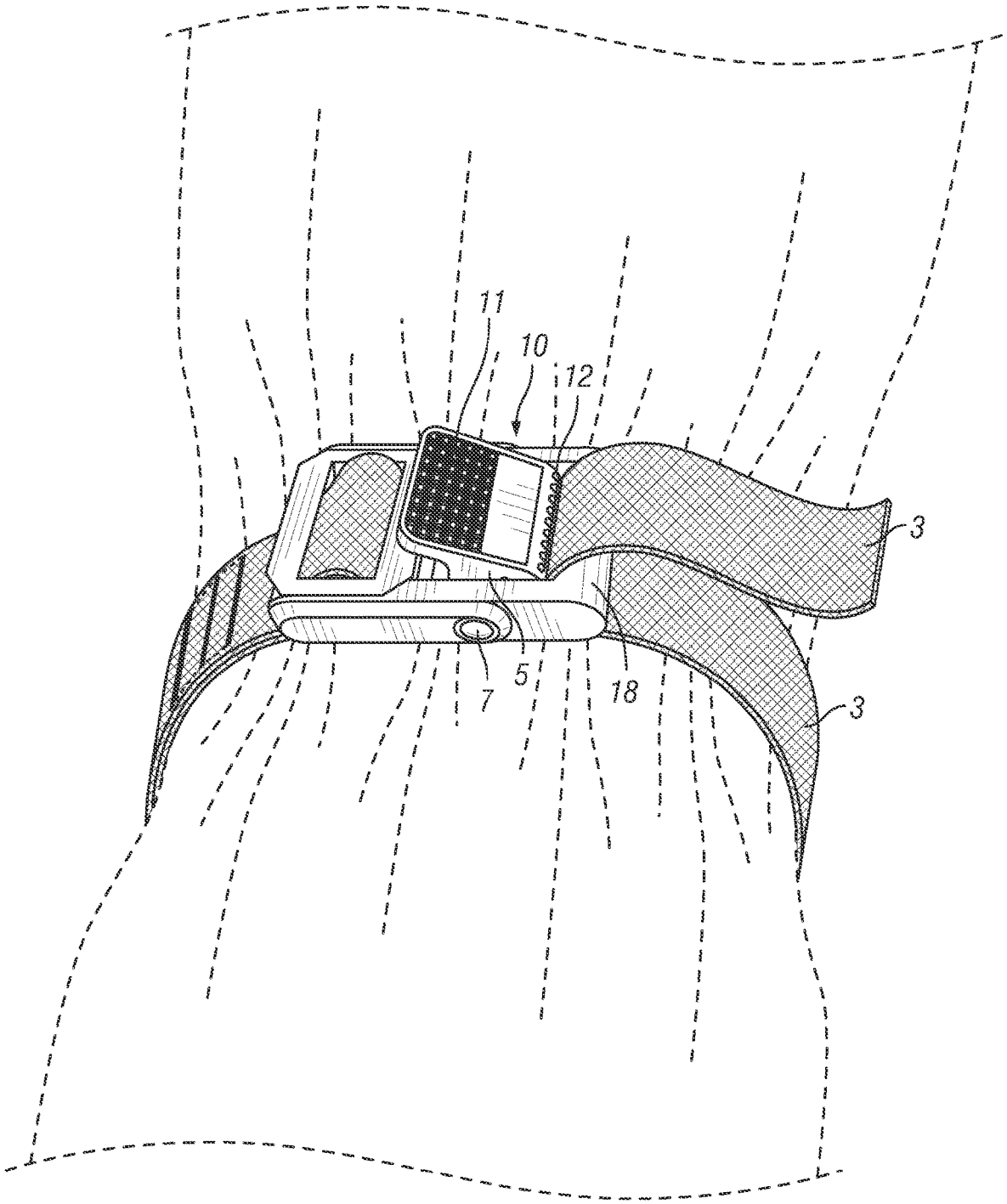
FIG. 5 is a perspective view of the present invention shown with the plate seated on top of the first part of the frame and the strap situated around an object.
Figure 6:
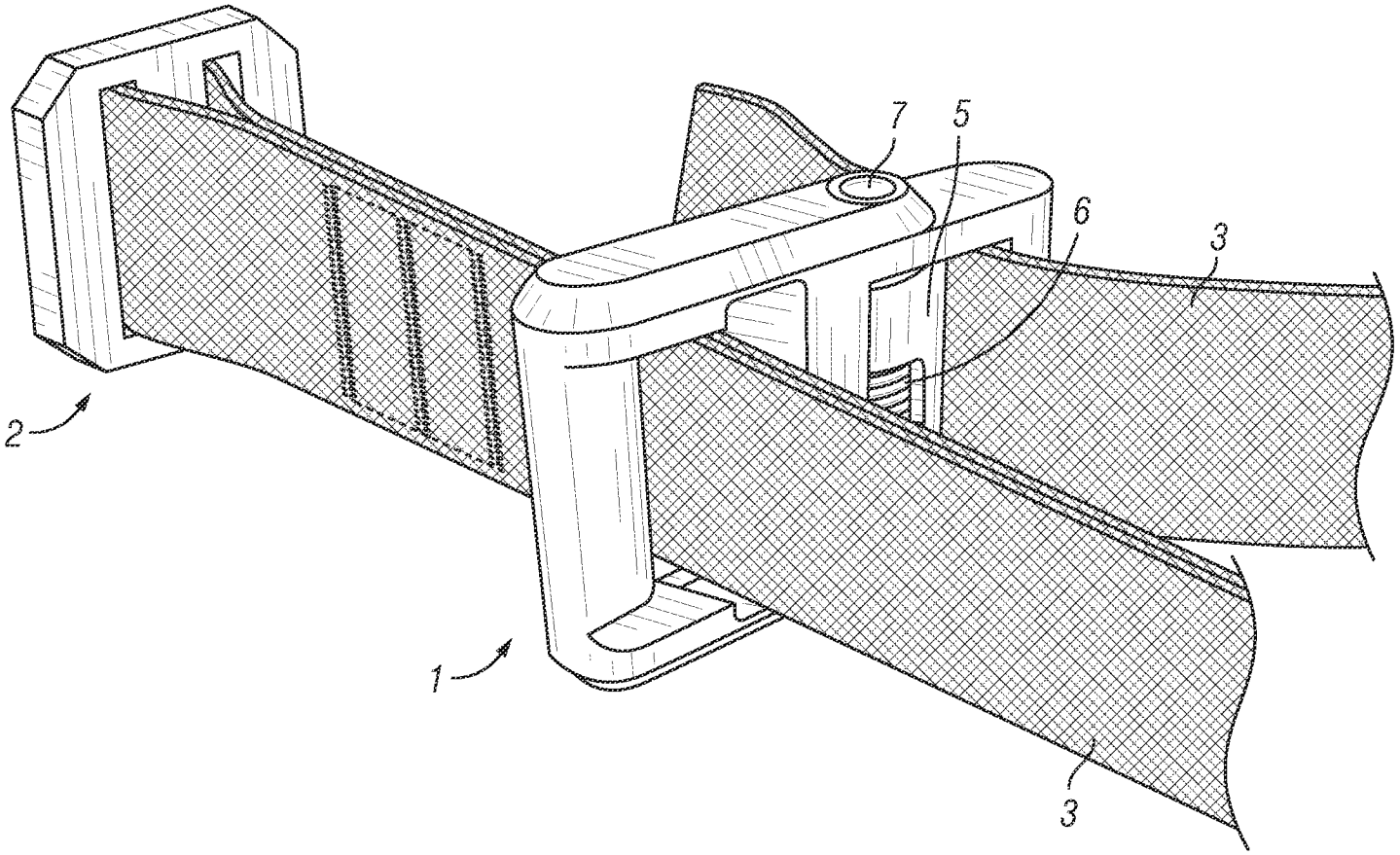
FIG. 6 is a perspective view of the present invention shown with the plate unseated and ready to be pulled back down through the second part of the frame to release the strap.

FIG. 5 is a perspective view of the present invention shown with the plate seated on top of the first part of the frame and the strap situated around an object. The present invention is configured so that once tension is placed on the strap, the plate 2 cannot be dislodged from its seat on the frame 4. The plate 2 cannot be moved from the position shown in FIG. 5 unless the user presses down on the release lever 5 to create some slack in the strap 3, moves the plate 2 off of the frame 4 (as shown in FIG. 6), and then slides the plate 2 back down through the second part 9 of the frame via the recesses 16, as described above.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A quick-release buckle comprising:

(a) a main body comprising a frame and a release lever that rotates about a shaft;

(b) a plate having two parallel and longitudinal slots, wherein the plate has a thickness and a width; and (c) a strap that passes through the slots in the plate;

wherein the frame comprises a first part and a second part;

wherein the first part of the frame and the second part of the frame are separated by an angled wall that extends laterally across a width of the frame;

wherein the shaft is secured to the first part of the frame;

wherein the second part of the frame is configured to form a seat for receiving the plate; and wherein the second part of the frame comprises two side walls and a channel on an inside surface of each side wall adjacent to the angled wall, each channel being parallel to the angled wall and at least as wide as the thickness of the plate, and wherein the two channels together are configured to receive the width of the plate.

2. The quick-release buckle of claim 1, wherein the strap is secured to itself with stitching after passing through the two slots in the plate.

3. The quick-release buckle of claim 1, wherein the strap is secured to itself with adhesive after passing through the two slots in the plate.

4. The quick-release buckle of claim 1, wherein the release lever comprises a spring that is situated around a center part of the shaft and configured to maintain the release lever in a closed position unless a user exerts manual force against the spring.

5. The quick-release buckle of claim 1, further comprising a plurality of teeth on the front of the release lever.

6. The quick-release buckle of claim 1, wherein the release lever comprises a thumb pad; and wherein the thumb pad comprises a plurality of rows of protrusions that increase in height from a front of the thumb pad to a back of the thumb pad.

7. The quick-release buckle of claim 1, wherein the frame comprises a top edge; and wherein the angle of the angled wall relative to the top edge of the frame is in the range of fifteen to forty-five degrees.

* * * * *